US005229683A

United States Patent [19]

Eckhardt et al.

[11] Patent Number: 5,229,683

[45] Date of Patent: Jul. 20, 1993

[54] ELECTRIC LAMP WITH CEMENTLESS BASE

[75] Inventors: Fritz Eckhardt, Gerstetten; Peter Helbig, Sontheim, both of Fed. Rep. of Germany

[73] Assignee: Patent-Treuhand-Gesellschaft für elektrische Glühlampen m.b.H., Munich, Fed. Rep. of Germany

[21] Appl. No.: 726,976

[22] Filed: Jul. 8, 1991

[30] Foreign Application Priority Data

Aug. 27, 1990 [DE] Fed. Rep. of Germany ..... 9012292

[51] Int. Cl.[5] ..... H01J 5/60

[52] U.S. Cl. ..... 313/318; 313/50; 313/51; 362/226

[58] Field of Search ..... 313/318, 43, 49, 50, 313/51, 269, 579; 362/226; 439/602, 611

[56] References Cited

U.S. PATENT DOCUMENTS

| | | | |
|---|---|---|---|
| 4,751,421 | 6/1988 | Braun et al. | 313/318 |
| 4,769,574 | 9/1988 | Nagasawa et al. | 313/318 |
| 4,950,942 | 8/1990 | Braun et al. | 313/318 |
| 5,010,272 | 4/1991 | Eckhardt et al. | 313/318 X |
| 5,029,057 | 7/1991 | Devir et al. | 313/318 X |

FOREIGN PATENT DOCUMENTS

| | | |
|---|---|---|
| 0171844 | 2/1986 | European Pat. Off. . |
| 1380283 | 10/1964 | France . |

*Primary Examiner*—Donald J. Yusko
*Assistant Examiner*—Ashok Patel
*Attorney, Agent, or Firm*—Frishauf, Holtz, Goodman & Woodward

[57] ABSTRACT

To facilitate manufacture, assembly, and save material, a halogen incandescent lamp (1) is secured to a plastic base (6) by a carrier or attachment element (3) which is formed of a single unitary element in form of a collar or cuff (4) of essentially rectangular cross section, surrounding the pinch or press seal of the lamp. The cuff is formed with internally projecting spring elements (17) in the form of flaps or the like, which are formed with notches engaging ribs (19) or similar suitable projections formed on the pinch seal of the lamp. First and second side walls of the essentially rectangular, in cross section, cuff or collar portions overlap, and the side walls are connected together by interengaging projections and slits, bent over at the corner of the rectangular cuff or collar portion.

13 Claims, 2 Drawing Sheets

ELECTRIC LAMP WITH CEMENTLESS BASE

Reference to related patent and application, the disclosures of which are hereby incorporated by reference, assigned to the assignee of the present application: U.S. Pat. No. 4,751,421, Braun et al. U.S. Ser. No. 07/726,975, filed Jul. 8, 1991, Schoenherr et al, now U.S. Pat. No. 5,153,480, Oct. 6, 1992.

FIELD OF THE INVENTION

The present invention relates to electric lamps, and more particularly lamps suitable for use in automotive vehicles, and especially automotive vehicle headlights, and more especially to a connection or holding arrangement to secure bulbs for such lamps into an insulating base structure.

BACKGROUND

The referenced U.S. Pat. No. 4,751,421, Braun et al, describes an arrangement to retain lamps in base structures, in which a lamp bulb holding or securing element, for example of stainless steel, couples the lamp bulb to the base. The two-part securing element is an assembly of two connected identical halves. When assembled, the securing element or attachment element or bulb carrier forms a cuff or collar surrounding a pinch seal of the lamp, and is additionally formed with depending flange or skirt portions which, in turn, can be coupled to a base of insulating material, for example by being formed with through-openings in the region of the base. If the base is made of plastic material, it can be plastic-welded to extend through the holes in the flange or skirt portion and securely connect the attachment or securing element to the base.

It has been found that manufacture of such lamps with two-part securing elements is comparatively expensive and has high material costs.

THE INVENTION

It is an object to provide a cementless attachment arrangement for an electric lamp bulb to a base, which provides a stable seat for the lamp bulb in the base, and which can be easily manufactured, assembled with the lamp bulb, and thus permits overall lowering of the manufacturing costs of the lamp as a whole.

Briefly, the attachment or securing element is a unitary metal structure which, in cross section or top view, is essentially rectangular-shaped to surround the pinch or press seal of the lamp, with clearance. The attachment element has two end regions which, when bent in the rectangular shape, form two sides of the rectangle. One of the sides is formed with projecting tabs which extend into slits formed in the other one. The end portions projecting over the edge of the rectangle are bent to overlap. In addition, the attachment element is formed with holding projections, for example extending inwardly, towards the lamp pinch or press seal, and engaging behind projections of the lamp pinch or press seal to hold the lamp resiliently, but securely, against the upper surface of the attachment element.

The unitary attachment element permits a material saving of about 65% with respect to the two-part stainless steel lamp securing element of the prior art structure. Assembly of the lamp bulb within the attachment element, further, is facilitated. It is only necessary to introduce the pinch seal of the lamp into the already completely assembled attachment element. This substantially reduces production costs for the lamp as a whole.

In accordance with a feature of the invention, the attachment portion is formed with inwardly projecting springy flaps which fit against rib elements or similar projections, extending laterally from the pinch or press seal of the lamp. This ensures a reliable connection between the lamp bulb and the attachment element. The springy, inwardly extending flaps or tabs located at opposite walls of the cuff or collar and, for example and preferably, at the wider sides thereof, ensure that the pinch or press seal, and hence the bulb, will be retained without play or chance of becoming loose.

Other arrangements to retain the pinch or press seal within the collar can be provided; preferably, however, recesses to retain the ribs or projections on the pinch or press seal are not directly formed in the walls of the cuff or collar portion but, rather, are located in edges of spring tabs or spring flaps which resiliently engage the pinch seal, extending from opposite sides of the collar, and clamping the pinch seal therebetween. The spring elements are directed in the insertion direction of the lamp so that, for assembly, the lamp bulb, with the pinch seal leading, can merely be inserted within the cuff or collar and snapped therein. The spring elements are preferably formed with inclined end surfaces to facilitate introduction of the pinch seal into the attachment element.

The skirt or flange portions of the attachment element are preferably embossed or ribbed in order to improve the stability thereof. The unitary attachment element also facilitates optical adjustment of the lamp with respect to the base as a whole, which is important if the base is to be located in a predetermined position within an optical system, for example a reflector.

DRAWINGS

DETAILED DESCRIPTION

Figure 1:
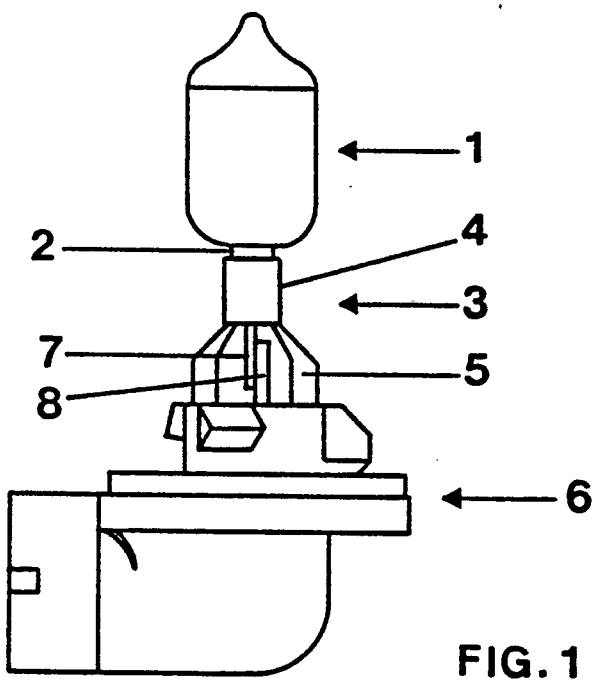
FIG. 1 is a schematic side view of the halogen incandescent lamp in a base, and attached to the base by an attachment element in accordance with the present invention.

The lamp-attachment base combination of FIG. 1 has a lamp bulb 1, pinch seal 2 and current supply leads 7 extending from the bulb outwardly of the pinch seal. The lamp bulb 1 is retained in a lamp attachment or carrier element 3 which, in turn, has two projecting, extending skirt or flange portions 5. The flange portions 5 are connected to a plastic base 6. The base 6 has suitable terminals 8 to which the leads 7 from the pinch seal 2 are connected, for example by welding or the like.

Figure 3:
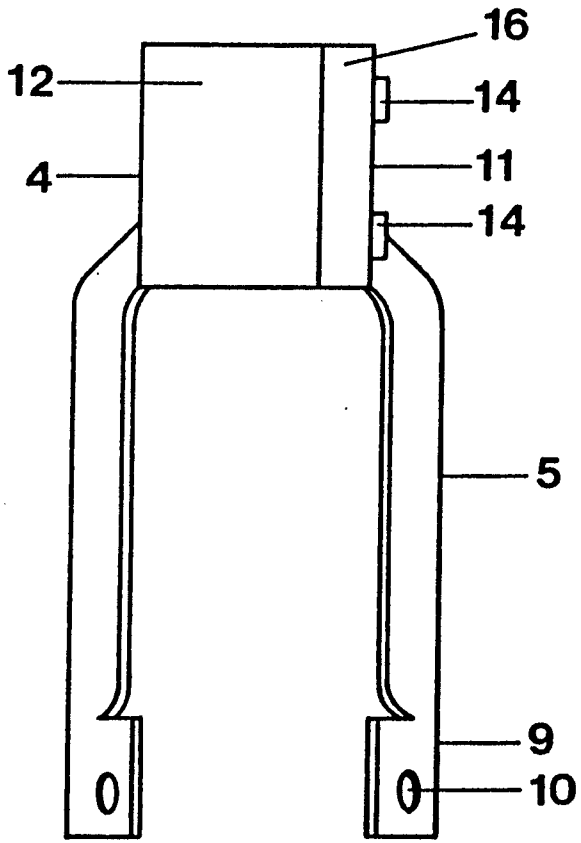
FIG. 3 is a side view of the attachment element rotated along ridge line 5*a* by 90° with respect to FIG. 2.
Figure 2:
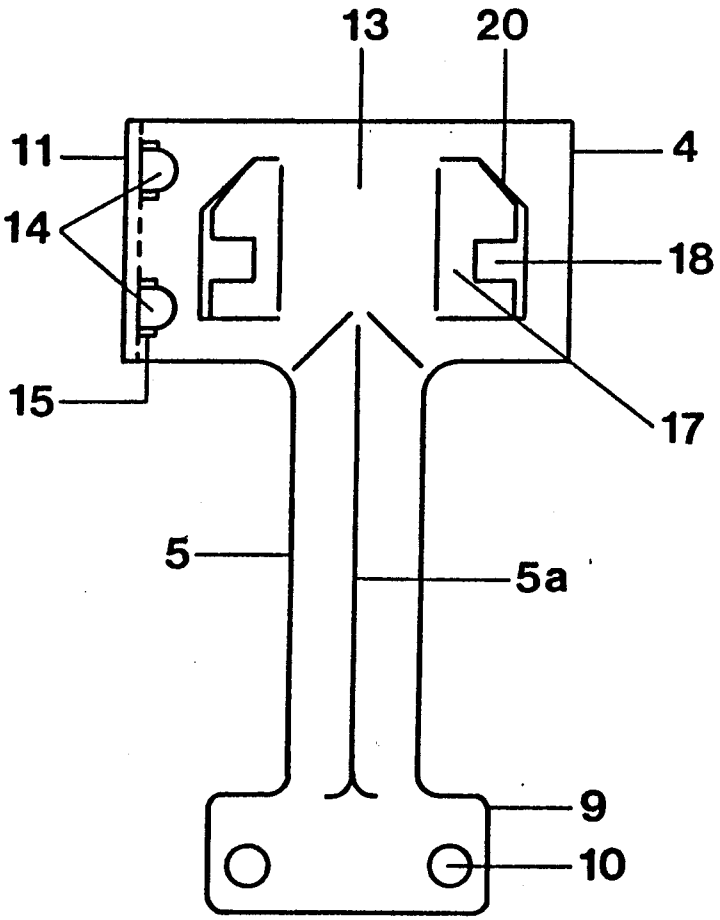
FIG. 2 is a front view of the attachment element for the complete lamp-base combination.

In accordance with a feature of the present invention, the lamp carrier or attachment element 3 is a single unitary metal structure which has a collar or cuff portion 4 (FIGS. 2–4) from which unitary skirt or flange portions 5 extend. The flange portions 5 are preferably embossed so that, in cross section, they have essentially V shape, defining a ridge line 5*a*. This shape of the flange or skirt portions contributes to their stability.

Figure 4:
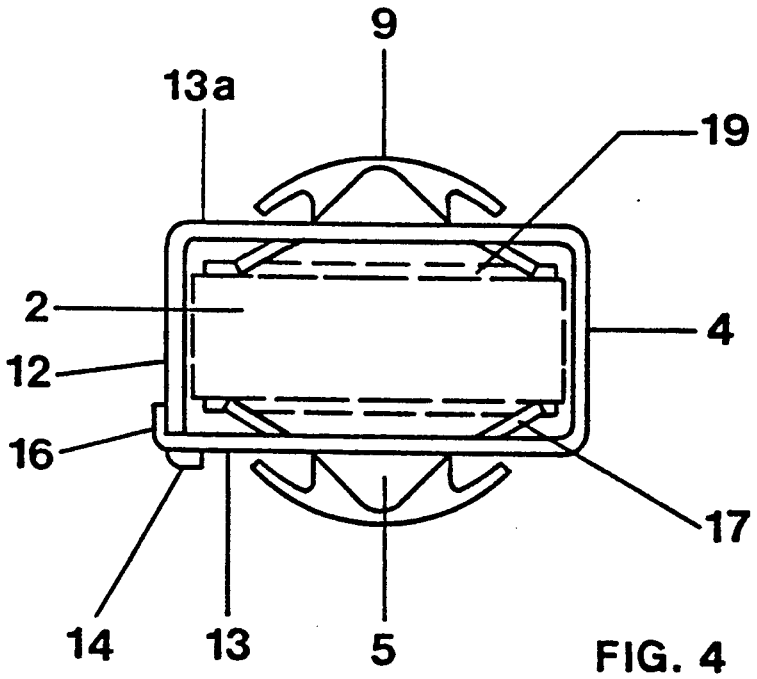
FIG. 4 is a top view of the attachment element, in which the pinch or press seal of the lamp is shown in broken lines.

The skirt or flange portions 5 terminate in ring segments 9, formed with through-bores or openings 10. The plastic base 6 and the ring segments 9 are connected by high-frequency welding, for example by having plastic material penetrate through the openings 10. The collar or cuff portion 4, in accordance with a feature of the invention, is formed from an elongated unitary element and bent in the form of a sleeve or hollow element of, in cross section or in a plan view, essentially rectangular shape. The walls of the collar or cuff portion 4 are unitary. The cuff portion 4 when bent in the rectangular shape, will define an edge 11 at which a first side wall 12 and a second side wall 13 come together. These walls overlap. One of the side walls, in the example the side wall 12, is formed with two projecting strips 14 which fit into aligned matching slits 15 on the second side wall 13. Upon bending over the tabs or projections 14, the side walls are connected together. The second side wall 13 has a wall portion 16 extending over the common edge 11 of the first and second side wall. This portion 16 is bent over at right angles, as best seen in FIG. 4, so that it engages against the side wall 12.

Two spring elements 17 are punched out from the second side wall 13 and an oppositely positioned side wall 13*a*, that is, from the wider side walls of the essentially, in cross section, rectangular attachment element 4. The punched out elements forming the spring elements 17 are directed to the interior of the hollow sleeve or collar 4. They engage against ribs 19 on lamp seal 2 which fit into recesses or notches 18 formed on the spring elements 17. The spring elements, additionally, are formed at their free edges with a chamfered or inclined surface 20 to facilitate insertion of the lamp. The notch or recess 18 of the spring flaps 17 extends from a lateral free edge thereof. The ribs 19 formed on the pinch or press seal 2 as well as the notches 18 fit or match in projection-recess connection within each other. This ensures that the lamp bulb 1 is retained stably and without play within the carrier or attachment element 3. The inclined surface 20 facilitates insertion of the bulb 1 into the carrier element 3.

Various changes and modifications may be made within the scope of the inventive concept.

We claim:

1. An electric lamp bulb-cementless base combination having a bulb (1), said bulb having a pinch seal (2) and current supply leads (7) extending from the bulb and through the pinch seal;

a base structure (6) of insulating material; and an attachment element (3) mechanically connecting the bulb (2) to the base structure (6), said attachment element including a cuff or collar portion engaged against said pinch seal (2) of the bulb (1) and holding the pinch seal in the cuff or collar portion; and a flange or skirt portion (5) engaged against and secured to the base structure (6), and interengaging projection-and-holding means (17, 18, 19) formed on the pinch seal and on the attachment element (3) to secure the bulb into the attachment element, wherein said attachment element comprises a unitary structure bent, in cross section or top plan view, in essentially rectangular shape and defining a first side wall (12) and a second side wall (13), said side walls (12, 13), when the structure is bent in said essentially rectangular shape, defining a corner edge (11), the first side wall (12) being formed with projecting tabs (14) and the second side wall (13) being formed with engagement slits (15) cut therein adjacent said edge (11), said projecting tabs being bent over said second side wall, and overlapping said second side wall.

2. The combination of claim 1, wherein said interengaging projection and holding means (17, 18, 19) comprise spring elements (17) punched out and project inwardly of the cuff or collar portion, and defining a free edge (4); wherein a recess or notch (18) is formed on the free outer edge of the punched-out spring element, and resiliently engages the pinch seal (2);

and projecting means (19) are formed on the pinch seal and positioned, dimensioned and shaped for engagement with and fitting into said recesses or notches (18) in the punched-out spring elements.

3. The combination of claim 2, wherein said projecting means comprises ribs (19).

4. The combination of claim 2, wherein said first side wall (12) is formed with an extending end portion (16), said extending end portion being bent over said first side wall (12) and overlapping said first side wall (12) adjacent said corner edge.

5. The combination of claim 2, wherein said spring elements extend inwardly from opposite side walls of said unitary structure.

6. The combination of claim 5, wherein said cuff or collar portion (4) of said attachment element, in cross section, is essentially rectangular and defines two long side walls (13, 13*a*); and wherein said spring elements are punched out from said long side walls.

7. The combination of claim 5, wherein said spring elements are formed with inclined surfaces at a region thereof in the vicinity of said bulb when said bulb and attachment element are assembled.

8. The combination of claim 1, wherein said first side wall (12) is formed with an extending end portion (16), said extending end portion being bent over said first side wall (12) and overlapping said first side wall (12) adjacent said corner edge.

9. The combination of claim 1, wherein said unitary structure is a metal structure, optionally a steel structure.

10. The combination of claim 1, wherein said flange or skirt portion comprises elongated strip elements which, in cross section, have an essentially V shape.

11. The combination of claim 10, wherein said first side wall (12) is formed with an extending end portion (16), said extending end portion being bent over said first side wall (12) and overlapping said first side wall (12) adjacent said corner edge.

12. The combination of claim 1, wherein said flange or skirt portion comprises elongated elements coupled to said cuff or collar portion, and unitary therewith, said elongated elements being formed with ring segments (9) at the ends thereof and remote from said cuff or collar portion, said ring segments being formed with openings (10) for high-frequency welding or melt connection with said base structure (6) of insulating material.

13. The combination of claim 12, wherein said first side wall (12) is formed with an extending end portion (16), said extending end portion being bent over said first side wall (12) and overlapping said first side wall (12) adjacent said corner edge.

* * * * *